US010741195B2

(12) United States Patent
Furuta

(10) Patent No.: US 10,741,195 B2
(45) Date of Patent: Aug. 11, 2020

(54) SOUND SIGNAL ENHANCEMENT DEVICE

(71) Applicant: MITSUBISHI ELECTRIC CORPORATION, Tokyo (JP)

(72) Inventor: Satoru Furuta, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 113 days.

(21) Appl. No.: 16/064,323

(22) PCT Filed: Feb. 15, 2016

(86) PCT No.: PCT/JP2016/054297
§ 371 (c)(1),
(2) Date: Jun. 20, 2018

(87) PCT Pub. No.: WO2017/141317
PCT Pub. Date: Aug. 24, 2017

(65) Prior Publication Data
US 2018/0374497 A1 Dec. 27, 2018

(51) Int. Cl.
*G10L 21/0264* (2013.01)
*G10L 21/0208* (2013.01)
(Continued)

(52) U.S. Cl.
CPC ..... *G10L 21/0264* (2013.01); *G10L 21/0208* (2013.01); *G10L 21/0232* (2013.01); *G10L 25/30* (2013.01)

(58) Field of Classification Search
CPC . G10L 21/02; G10L 21/0208; G10L 21/0264; G10L 25/30
See application file for complete search history.

(56) References Cited

U.S. PATENT DOCUMENTS 5,432,883 A * 7/1995 Yoshihara ..... G10L 19/04 704/201
5,699,480 A * 12/1997 Martin ..... G10L 21/0208 704/205
(Continued)

FOREIGN PATENT DOCUMENTS

JP 5-232986 A 9/1993
JP 11-259445 A 9/1999

OTHER PUBLICATIONS

Kim et al., "Speech enhancement using receding horizon FIR filtering." Transaction on Control, Automation, and Systems Engineering, vol. 2, Issue 1, pp. 7-12, Mar. 2000. (Year: 2000).*
(Continued)

*Primary Examiner* — Daniel C Washburn
*Assistant Examiner* — Oluwadamilola M Ogunbiyi
(74) *Attorney, Agent, or Firm* — Birch, Stewart, Kolasch & Birch, LLP.

(57) ABSTRACT

A first signal weighting processor outputs a weighted signal obtained by performing a weighting on part of an input signal representing a feature of a target signal included in the input signal. A neural network processor outputs an enhancement signal for the target signal by using a coupling coefficient. An inverse filter cancels the weighting on the feature representation of the target signal in the enhancement signal. A second signal weighting processor outputs a weighted signal obtained by performing a weighting on part of a supervisory signal representing a feature of a target signal. An error evaluator output a coupling coefficient to have a value indicating that a learning error between the weighted signal output from the second signal weighting processor and the output signal of the neural network processor is less than or equal to a set value.

4 Claims, 7 Drawing Sheets

(51) Int. Cl.
*G10L 21/0232* (2013.01)
*G10L 25/30* (2013.01)

(56) References Cited

U.S. PATENT DOCUMENTS 5,812,970 A * 9/1998 Chan ..... G10L 21/0208 704/226
5,920,839 A * 7/1999 Iso ..... G10L 15/142 704/232
7,076,168 B1 * 7/2006 Shattil ..... H04B 10/25752 398/202
9,485,597 B2 * 11/2016 Bradley ..... H04R 29/00
2003/0009326 A1 * 1/2003 Wang ..... G10L 21/0364 704/219
2003/0033094 A1 * 2/2003 Huang ..... G06F 17/14 702/39
2006/0031066 A1 * 2/2006 Hetherington ..... G10L 21/0208 704/226
2006/0116874 A1 * 6/2006 Samuelsson ..... G10L 19/26 704/228
2007/0025421 A1 * 2/2007 Shattil ..... H04B 10/25752 375/136
2008/0310646 A1 * 12/2008 Amada ..... G10L 19/008 381/73.1
2012/0022880 A1 * 1/2012 Bessette ..... G10L 19/022 704/503
2013/0223639 A1 * 8/2013 Sugiyama ..... G10K 11/16 381/71.1
2014/0136451 A1 * 5/2014 Marti ..... G06N 20/00 706/12
2015/0208170 A1 * 7/2015 Kraft ..... G10L 21/0232 381/99
2016/0019890 A1 * 1/2016 Amman ..... G10L 25/60 704/233
2016/0254007 A1 * 9/2016 Guo ..... G10L 21/0208 704/226
2017/0011753 A1 * 1/2017 Herbig ..... H04R 3/00
2017/0100078 A1 * 4/2017 Han ..... G16H 50/50
2018/0233129 A1 * 8/2018 Bakish ..... G10L 21/0272

OTHER PUBLICATIONS

Wan et al., "Neural dual extended Kalman filtering: Applications in speech enhancement and monaural blind signal separation." Neural Networks for Signal Processing VII. Proceedings of the 1997 IEEE Signal Processing Society Workshop, p. 466-467, 1997. (Year: 1997).*
Wolfgang et al., "Neural Network Filters for Speech Enhancement," IEEE Transactions on Speech and Audio Processing, vol. 3, Issue 6, p. 433-438, Nov. 1995. (Year: 1995).*
Yegnanarayana et al., "Speech enhancement using linear prediction residual," Speech Communication vol. 28, Issue 1, pp. 25-42, 1999. (Year: 1999).*
Weninger et al., "Discriminatively Trained Recurrent Neural Networks for Single-Channel Speech Separation", 2014 IEEE Global Conference on Signal and Information Processing (GlobalSIP), 2014, 5 pages.

* cited by examiner

SOUND SIGNAL ENHANCEMENT DEVICE

TECHNICAL FIELD

The present invention relates to a sound signal enhancement device for enhancing a target signal, which has been included in an input signal, by suppressing unnecessary signals other than the target signal.

BACKGROUND ART

Along with a progress of technology of digital signal processing in recent years, voice communication through mobile phones in the outdoors, hands-free voice communication within automobiles, and hands-free operation by speech recognition are widely spread. Automatic monitoring systems have been also developed, which capture and detect screams or yells of people or abnormal sounds or vibrations generated by machines.

Devices that implement the foregoing functions are often used in a noisy environment, such as the outdoors or plants, or in a highly echoing environment where sound signals generated by speakers or other devices reach a microphone. Thus, unnecessary signals, such as background noise or sound echo signals, are also input together with a target signal to a sound transducer like a microphone or a vibration sensor. This action may result in deterioration of communication sound and a decrease in the voice recognition rate, the detection rate of abnormal sounds, and the like. Therefore, in order to implement comfortable voice communication, high-accuracy voice recognition, or high-accuracy abnormal sound detection, a sound signal enhancement device is needed, which is able to suppresses unnecessary signals included in an input signal (hereinafter, the foregoing unnecessary signals are referred to as "noise") other than a target signal and enhances only the target signal.

Conventionally, there is a method using a neural network as a method for enhancing a target signal only (see, for example, Patent Literature 1). In the conventional method, a target signal is enhanced by improving the SN ratio of an input signal by using the neural network.

CITATION LIST

Patent Literature 1: JP 05-232986 A

SUMMARY OF INVENTION

A neural network has a plurality of processing layers, each including coupling elements. A weighting coefficient (referred to as a coupling coefficient) indicating the coupling strength is set between coupling elements for each pair of the layers. It is necessary to initially set the coupling coefficients of the neural network in advance depending on a purpose. Such an initial setting is called learning of the neural network. In general learning of a neural network, a difference between an operation result of the neural network and supervisory signal data is defined as a learning error, and a coupling coefficient is repeatedly changed so as to minimize the square sum of the learning error by a back propagation method or other methods.

Generally, in a neural network, a coupling coefficient between coupling elements is optimized by learning with using a large amount of learning data, and as a result, accuracy of the signal enhancement is improved. However, with regard to signals having less frequency in occurrence of a target signal or noise, such as voice not normally uttered such as screams or yells, sounds accompanied by natural disasters such as an earthquake, disturbance sound unexpectedly generated such as gunshots, abnormal sounds or vibrations presaging a failure of a machine, or warning sounds output when a machine error occurs, it is only possible to collect a small amount of learning data. This is because a large number of constraints are imposed such as that the collection of a large amount of learning data requires a great amount of time and cost, or that a manufacturing line is needed to stop in order to issue a warning sound. Therefore, in the conventional method as disclosed in Patent Literature 1, learning of a neural network does not work well due to the insufficient learning data, and thus there is a problem that accuracy of the enhancement may deteriorate.

The present invention has been made to resolve the foregoing problems. An object of the present invention is to provide a sound signal enhancement device capable of obtaining a high quality enhancement signal of a sound signal even when the amount of learning data is small.

A sound signal enhancement device according to the present invention includes: the sound signal enhancement device of the Embodiment 1 includes: a first signal weighting processor configured to perform a weighting on part of an input signal representing a feature of a target signal, and configured to output a weighted signal, the input signal including the target signal and the noise; a neural network processor configured to perform, on the weighted signal output from the first signal weighting processor, enhancement of the target signal by using a coupling coefficient, and configured to output an enhancement signal; an inverse filter configured to cancel the weighting on the feature representation of the target signal in the enhancement signal; a second signal weighting processor configured to perform a weighting on part of an supervisory signal representing a feature of a target signal or noise, and configured to output a weighted signal, the supervisory signal being used for learning a neural network; and an error evaluator configured to calculate a coupling coefficient having a value indicating that a learning error between the weighted signal output from the second signal weighting processor and the enhancement signal output from the neural network processor is less than or equal to a set value, and configured to output a result of the calculation as the coupling coefficient.

A sound signal enhancement device according to the present invention performs weighting of a feature of a target signal by using the first signal weighting processor configured to perform a weighting on part of an input signal representing a feature of a target signal, and configured to output a weighted signal, the input signal including the target signal and the noise, and the second signal weighting processor configured to perform a weighting on part of an supervisory signal representing a feature of a target signal, and configured to output a weighted signal, the supervisory signal being used for learning a neural network. As a result, it is possible to obtain a high-quality enhancement signal of a sound signal even when the amount of learning data is small.

2D is an explanatory diagram of a spectrum of an enhancement signal according to the Embodiment 1.

Figure 3:
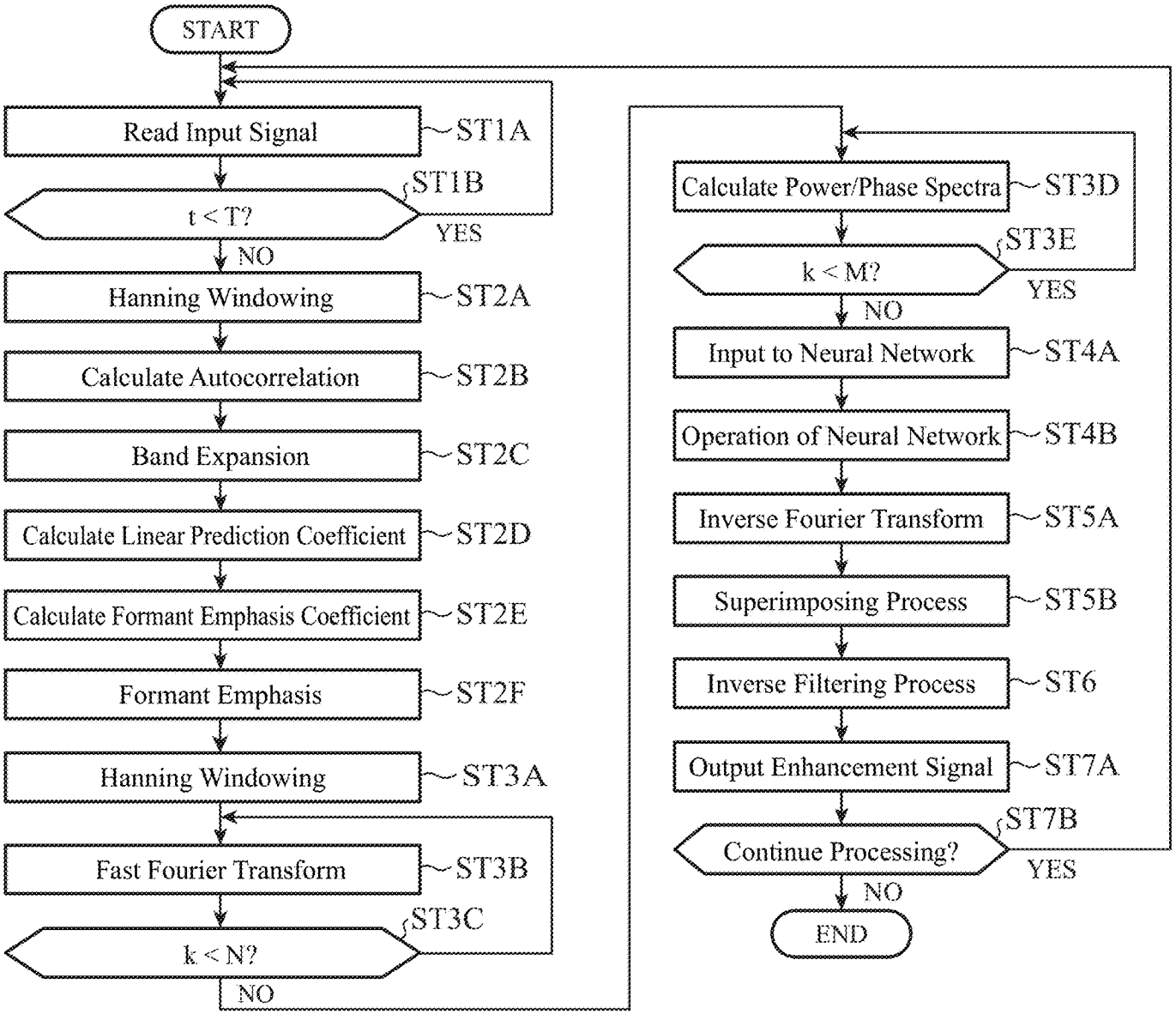

FIG. 3 is a flowchart illustrating an example of a procedure of sound signal enhancing process of the sound signal enhancement device according to the Embodiment 1 of the present invention.

Figure 4:
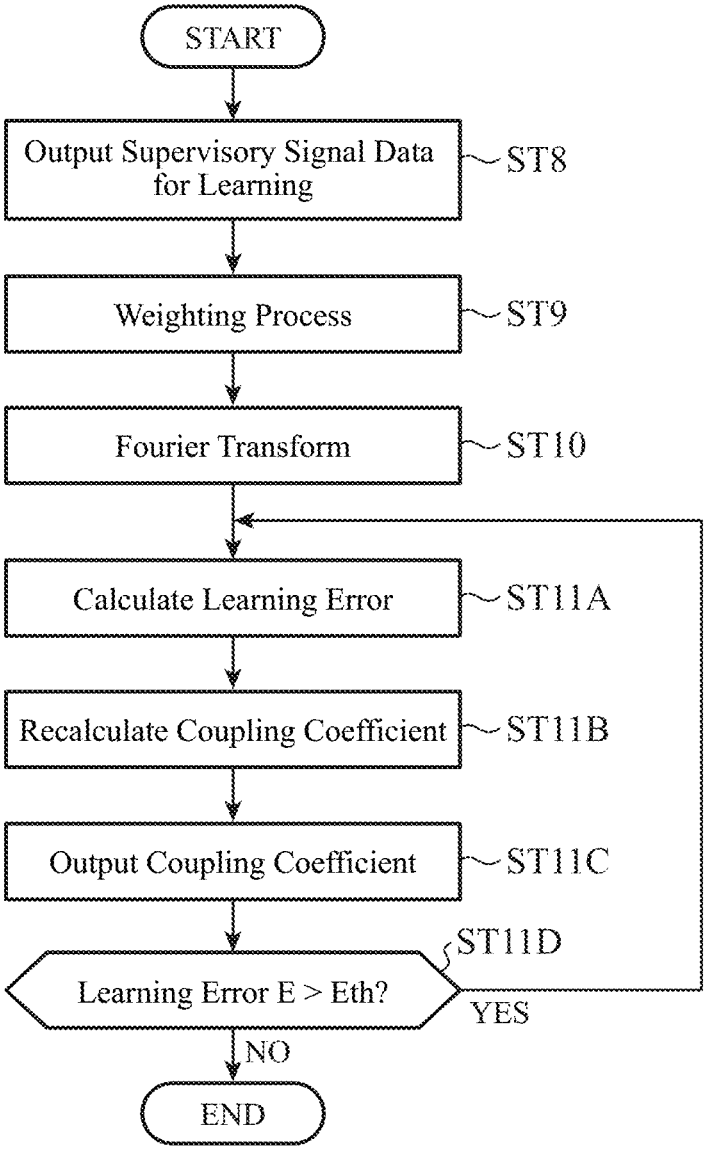

FIG. 4 is a flowchart illustrating an example of a procedure of neural network learning of the sound signal enhancement device according to the Embodiment 1 of the present invention.

Figure 5:
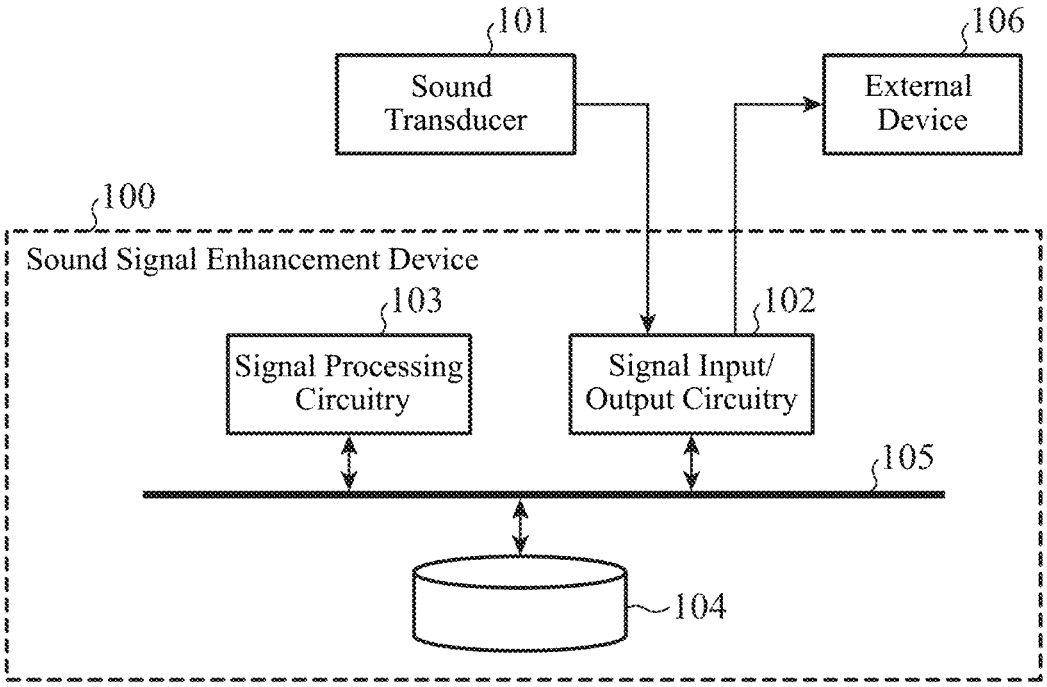

FIG. 5 is a block diagram illustrating a hardware structure of the sound signal enhancement device according to the Embodiment 1 of the present invention.

Figure 6:
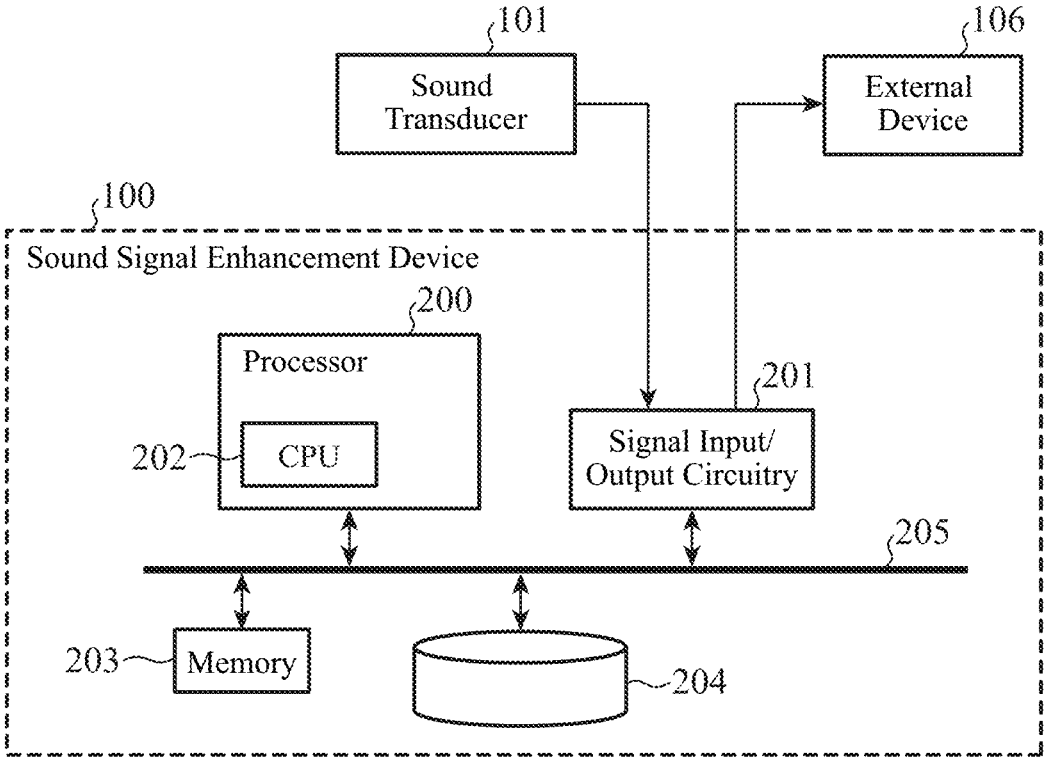

FIG. 6 is a block diagram illustrating a hardware structure in the case of implementing the sound signal enhancement device of the Embodiment 1 of the present invention by using a computer.

Figure 7:
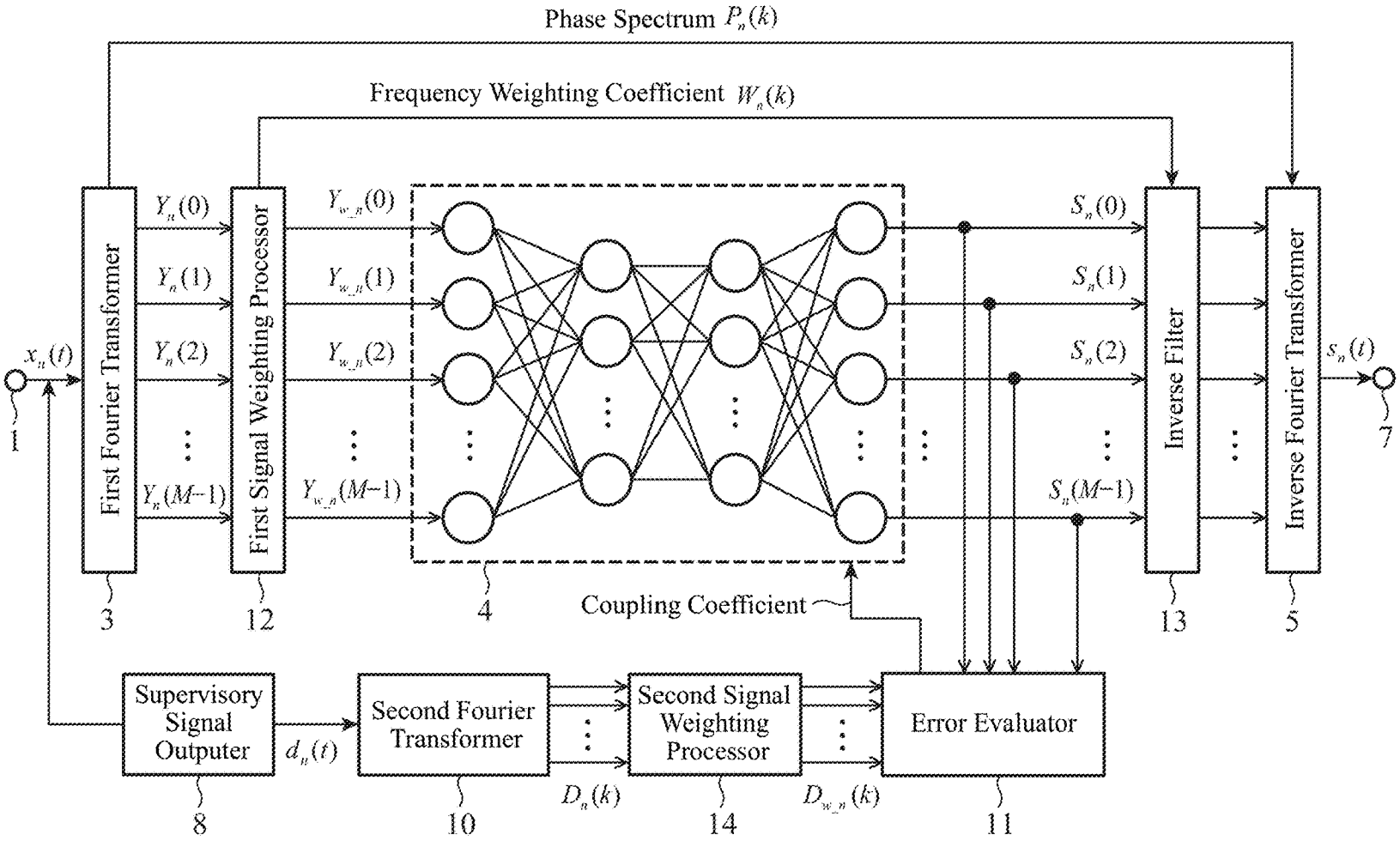

FIG. 7 is a block diagram of a sound signal enhancement device according to Embodiment 2 of the present invention.

Figure 8:
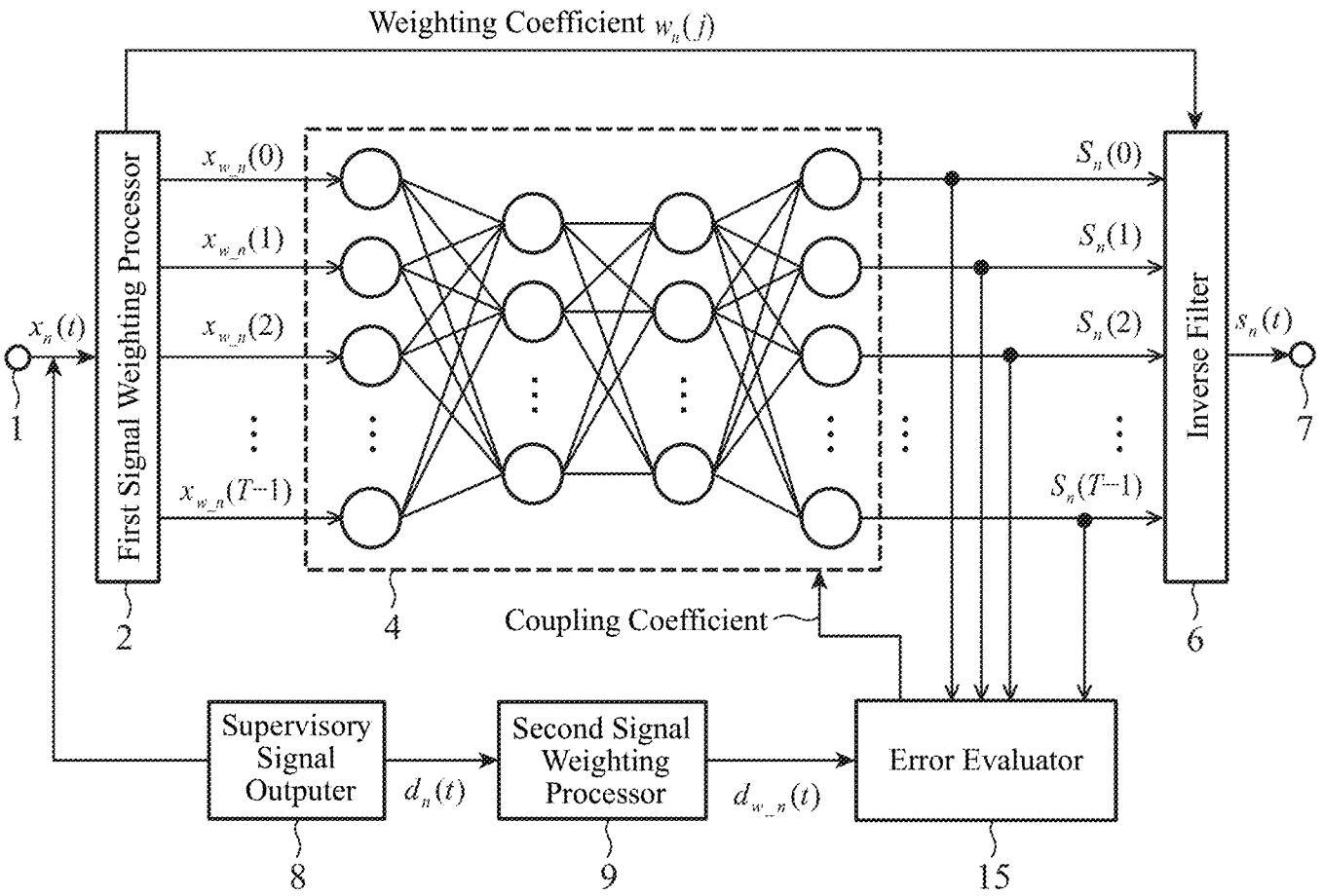

FIG. 8 is a block diagram of a sound signal enhancement device according to Embodiment 3 of the present invention.

DESCRIPTION OF EMBODIMENTS

In order to describe the present invention in detail, embodiments for carrying out the present invention will be described below along the accompanying drawings.

Embodiment 1

Figure 1:
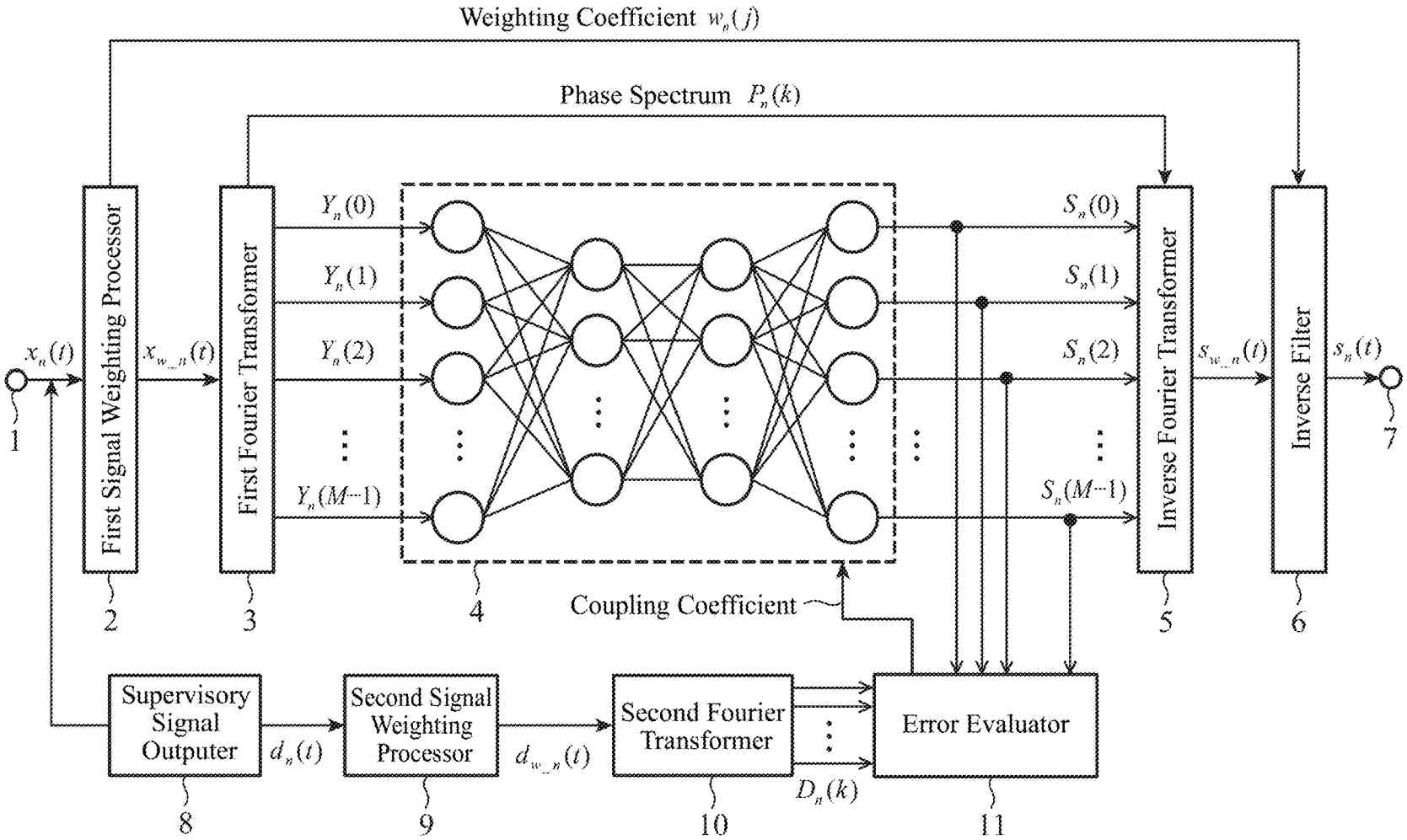
FIG. 1 is a block diagram of a sound signal enhancement device according to Embodiment 1 of the present invention.

FIG. 1 is a block diagram illustrating a schematic configuration of a sound signal enhancement device according to Embodiment 1 of the present invention. The sound signal enhancement device illustrated in FIG. 1 includes a signal input part 1, a first signal weighting processor 2, a first Fourier transformer 3, a neural network processor 4, an inverse Fourier transformer 5, an inverse filter 6, a signal output part 7, a supervisory signal outputer 8, a second signal weighting processor 9, a second Fourier transformer 10, and an error evaluator 11.

An input to the sound signal enhancement device may be a sound signal such as speech sound, music, signal sound, or noise read through a sound transducer like a microphone (not shown) or a vibration sensor (not shown). These sound signals are converted from analog to digital (A/D conversion), sampled at a predetermined sampling frequency (for example, 8 kHz), and divided into frame units (for example, 10 ms) to generate signals for input. Here, an operation will be described with an example in which speech sound is used as a sound signal being a target signal.

A configuration and an operation principle of the sound signal enhancement device of the Embodiment 1 will be described below with reference to FIG. 1.

The signal input part 1 reads the foregoing sound signals at predetermined frame intervals, and outputs the sound signals, each being an input signal $x_n(t)$ in the time domain, to the first signal weighting processor 2. Here, "n" denotes a frame number when the input signal is divided into frames, and "t" denotes a discrete-time number in sampling.

The first signal weighting processor 2 is a processing part that performs a weighting process on part of the input signal $x_n(t)$, which well represents features of a target signal. Formant emphasis used for enhancing an important peak component in a speech spectral (a component having a large spectrum amplitude), a so-called formant, can be applied to the signal weighting process in the present embodiment.

The formant emphasis can be performed by, for example, finding an autocorrelation coefficient from a Hanning-windowed speech signal, performing band expansion processing, finding a twelfth-order linear prediction coefficient with the Levinson-Durbin method, finding a formant emphasis coefficient from the linear prediction coefficient, and then filtering through a combined filter of an autoregressive moving average (ARMA) type that uses the formant emphasis coefficient. The formant emphasis is not limited to the above-described method, and other known methods may be used.

Moreover, a weighting coefficient $w_n(j)$ used for the foregoing weighting is output to the inverse filter 6 which will be detailed later. Here, "j" denotes an order of the weighting coefficient and corresponds to a filter order of a formant emphasis filter.

As a signal weighting method, not only the formant emphasis described above but also a method using auditory masking, for example, can be used. The auditory masking refers to a characteristic of human auditory sense that a large spectral amplitude at a certain frequency may hinder a spectral component having a smaller amplitude at a peripheral frequency from being perceived. Suppressing the masked spectral component (having the smaller amplitude) allows for relative enhancing process.

As another method of weighting process of a feature of the speech signal of the first signal weighting processor 2, it is possible to perform pitch emphasis that enhances a pitch indicating the fundamental cyclic structure of voice. Alternatively, it is also possible to perform filtering process that enhances only a specific frequency component of warning sound or abnormal sound. For example, in a case where a frequency of warning sound is a sine wave of 2 kHz, it is possible to perform the band enhancing filtering process to increase, by 12 dB, the amplitude of frequency components within ±200 Hz around 2 kHz as the central frequency.

The first Fourier transformer 3 is a processing part that transforms the signal weighted by the first signal weighting processor 2 into a spectrum. That is, for example, Hanning windowing is performed on the input signal $x_{w_n}(t)$ weighted by the first signal weighting processor 2, and then fast Fourier transform of 256 points, for example, is performed as in the following mathematical equation (1), thereby transforming into a spectral component $X_{w_n}(k)$ from the signal $x_{w_n}(t)$ in the time domain.

$$X_{w_n}(k)=FFT[x_{w_n}(t)] \tag{1}$$

Where "k" represents a number designating a frequency component in the frequency band of a power spectrum (hereinafter referred to as a spectrum number), and "FFT[•]" represents a fast Fourier transform operation.

Subsequently, the first Fourier transformer 3 calculates a power spectrum $Y_n(k)$ and a phase spectrum $P_n(k)$ from the spectral component $X_{w_n}(k)$ of the input signal by using the following mathematical equations (2). The resulting power spectrum $Y_n(k)$ is output to the neural network processor 4. The resulting phase spectrum $P_n(k)$ is output to the inverse Fourier transformer 5.

$$\begin{aligned} Y_n(k) &= \mathrm{Re}\{X_{w_n}(k)\}^2 + \mathrm{Im}\{X_{w_n}(k)\}^2 \\ P_n(k) &= \mathrm{Arg}(\mathrm{Re}\{X_{w_n}(k)\}^2 + \mathrm{Im}\{X_{w_n}(k)\}^2) \end{aligned} \quad ; 0 \le k < M \tag{2}$$

$\mathrm{Re}\{X_n(k)\}$ and $\mathrm{Im}\{X_n(k)\}$ represent a real part and an imaginary part, respectively, of the input signal spectrum after the Fourier transform, and M=128.

The neural network processor 4 is a processing part that enhances the spectrum after conversion at the first Fourier transformer 3 and outputs an enhancement signal in which the target signal is enhanced. That is, the neural network processor 4 has M input points (or nodes) corresponding to the power spectrum $Y_n(k)$ described above. The 128 power spectrum $Y_n(k)$ is input to the neural network. In the power spectrum $Y_n(k)$, the target signal is enhanced by network processing based on a coupling coefficient having been learned in advance, and is output as an enhanced power spectrum $S_n(k)$.

The inverse Fourier transformer 5 is a processing part that transforms the enhanced spectrum into an enhancement signal in the time domain. That is, inverse Fourier transform is performed based on the enhanced power spectrum $S_n(k)$ output from the neural network processor 4 and the phase spectrum $P_n(k)$ output from the first Fourier transformer 3. After that, a superimposing process is performed on a result of the inverse Fourier transform with a result of a previous frame of the processing stored in an internal memory for primary storage such as a RAM, and then a weighted enhancement signal $s_{w_n}(t)$ is output to the inverse filter 6.

The inverse filter 6 performs, by using the weighting coefficient $w_n(j)$ coming from the first signal weighting processor 2, an operation reverse to that in the first signal weighting processor 2, namely, filtering process to cancel the weighting on the weighted enhancement signal $s_{w_n}(t)$, and outputs the enhancement signals $s_n(t)$.

The signal output part 7 externally outputs the enhancement signals $s_n(t)$ enhanced by the above method.

Note that, although the power spectrum obtained by the fast Fourier transform is used as the signal input to the neural network processor 4 of the present embodiment, the present invention is not limited to thereto. Similar effects can be obtained by, for example, using acoustic feature parameters such as "cepstrum", or by using known conversion processing such as cosine transform or wavelet transform instead of the Fourier transform. In the case of wavelet transform, a wavelet can be used instead of a power spectrum.

The supervisory signal outputer 8 holds a large amount of signal data used for learning coupling coefficients of the neural network processor 4 and outputs the supervisory signal $d_n(t)$ at the time of the learning. An input signal corresponding to the supervisory signal $d_n(t)$ is also output to the first signal weighting processor 2. In this embodiment, it is assumed that the target signal is speech sound, the supervisory signal is a predetermined speech signal not including noise, and the input signal is a signal including the same supervisory signal together with noise.

The second signal weighting processor 9 performs weighting process on the supervisory signal $d_n(t)$ in the manner equivalent to that in the first signal weighting processor 2, and outputs a weighted supervisory signal $d_{w_n}(t)$.

The second Fourier transformer 10 performs fast Fourier transform process in the manner equivalent to that in the first Fourier transformer 3 and outputs a power spectrum $D_n(k)$ of the supervisory signal.

The error evaluator 11 calculates a learning error E defined in the following mathematical equation (3) by using the enhanced power spectrum $S_n(k)$ output from the neural network processor 4 and the power spectrum $D_n(k)$ of the supervisory signal output from the second Fourier transformer 10, and outputs a resulting coupling coefficient to the neural network processor 4.

$$E = \sum_{k=0}^{M-1} \{S_n(k) - D_n(k)\}^2 \tag{3}$$

Using the learning error E as an evaluation function, an amount of change in a coupling coefficient is calculated by a back propagation method, for example. Until the learning error E becomes sufficiently small, each coupling coefficient in the neural network is updated.

Note that the supervisory signal outputer 8, the second signal weighting processor 9, the second Fourier transformer 10, and the error evaluator 11 described above are operated only at the time of network learning of the neural network processor 4, that is, only when coupling coefficients are initially optimized. Alternatively, coupling coefficients of the neural network may be optimized by performing sequential or full-time operation while changing supervisory data depending on condition of the input signal.

Even when the condition of the input signal changes due to, for example, a change in a type or magnitude of noise included in the input signal, it is possible to perform enhancing process capable of promptly following the change in condition of the input signal by performing sequential or full-time operation of the supervisory signal outputer 8, the second signal weighting processor 9, the second Fourier transformer 10, and the error evaluator 11. This configuration is able to provide the sound signal enhancement device with higher quality.

Figure 2A:
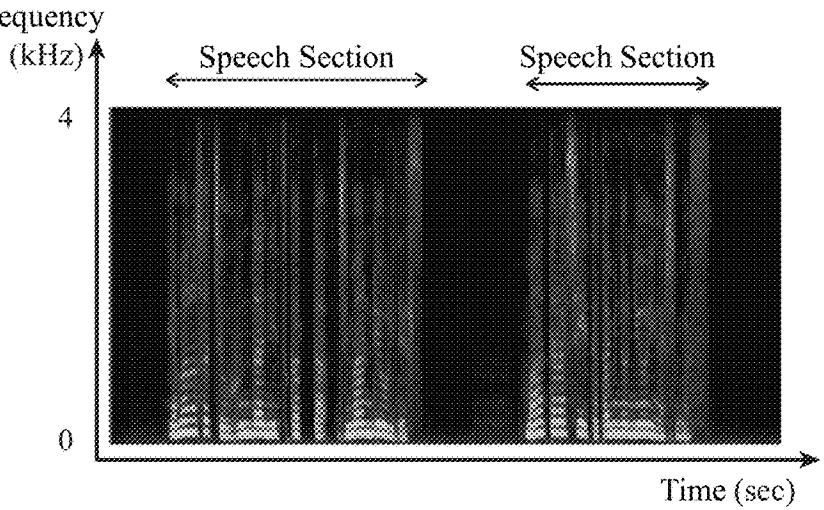
FIG. 2A is an explanatory diagram of a spectrum of a target signal.
Figure 2B:
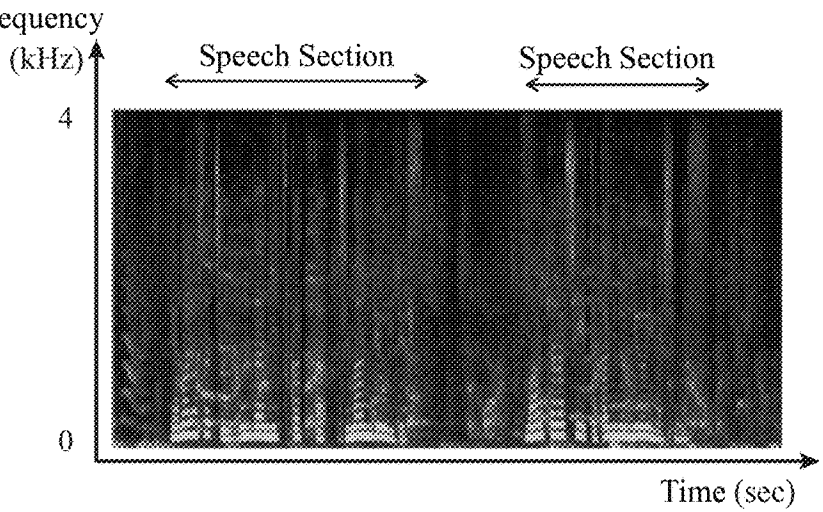
FIG. 2B is an explanatory diagram of a spectrum in a case where noise is included in the target signal.
Figure 2C:
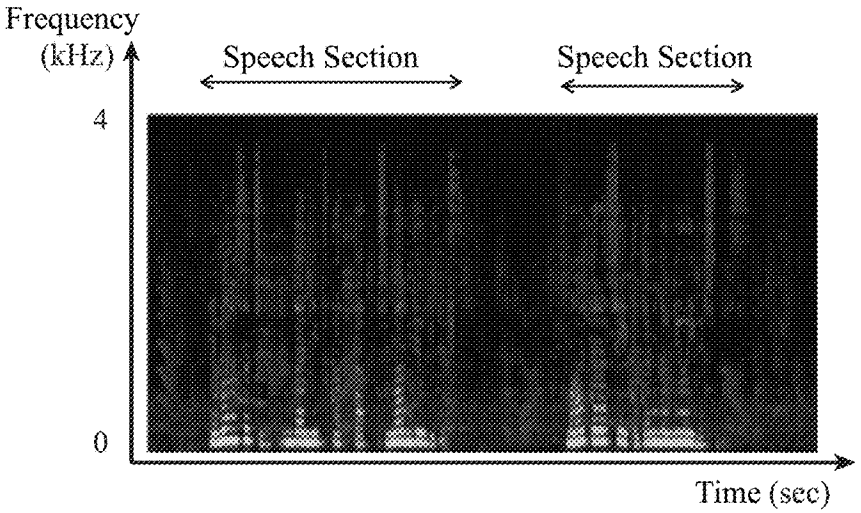
FIG. 2C is an explanatory diagram of a spectrum of an enhancement signal by a conventional method, and FIG.
Figure 2D:
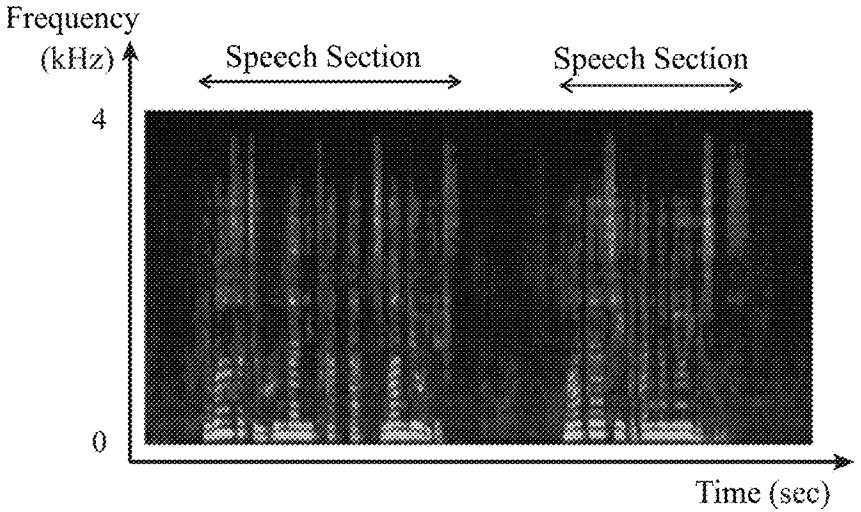

FIGS. 2A to 2D are explanatory diagrams of output signals of the sound signal enhancement device according to the Embodiment 1. FIG. 2A represents a spectrum of a speech signal being a target signal. FIG. 2B represents a spectrum of an input signal in which street noise is included together with the target signal. FIG. 2C represents a spectrum of an output signal obtained through an enhancing process with a conventional method. FIG. 2D represents a spectrum of an output signal obtained through an enhancing process performed by the sound signal enhancement device according to the Embodiment 1. Each of FIGS. 2C and 2D indicates a running spectrum of an enhanced power spectrum $S_n(k)$.

In each of the figures, a vertical axis represents frequencies (the frequency rises upward), and a horizontal axis represents time. In addition, in each of the figures, the white part indicates a large power of a spectrum, and the power of the spectrum decreases as the color becomes darker. It can be seen that the spectrum of high frequencies of the speech signal is attenuated in a conventional method illustrated in FIG. 2C, whereas the spectrum of high frequencies of a speech signal is not attenuated but is enhanced in the method according to the present embodiment in FIG. 2D. The effect of the present invention can be confirmed.

Next, the operation of each of the elements in the sound signal enhancement device will be described with reference to the flowchart of FIG. 3.

The signal input part 1 reads a sound signal at predetermined frame intervals (step ST1A) and outputs it to the first signal weighting processor 2 as an input signal $x_n(t)$ as a signal in the time domain. When the sample number t is smaller than a predetermined value T (YES in step ST1B), the processing of step ST1A is repeated until reaching T=80.

The first signal weighting processor 2 performs weighting process by the formant emphasis on part of the input signal $x_n(t)$, which well represents the feature of a target signal included in this input signal.

The formant emphasis is sequentially performed in accordance with the following process. First, Hanning windowing is performed on the input signal $x_n(t)$ (step ST2A). An autocorrelation coefficient of the Hanning-windowed input signal is calculated (step ST2B), and a band expansion process is performed (step ST2C). Next, a twelfth-order linear prediction coefficient is calculated by the Levinson-Durbin method (step ST2D), and a formant emphasis coefficient is calculated from the linear prediction coefficient (step ST2E). After that, a filtering process is performed with an ARMA type combined filter that uses the calculated formant emphasis coefficient (step ST2F).

The first Fourier transformer 3 performs, for example, Hanning windowing on the input signal $x_{w_n}(t)$ weighted by the first signal weighting processor 2 (step ST3A). The first Fourier transformer 3 performs the fast Fourier transform using, for example, 256 points through the foregoing mathematical equation (1) to transform the time domain signal $x_{w_n}(t)$ into a signal $x_{w_n}(k)$ of a spectral component (step ST3B). When the spectrum number k is smaller than a predetermined value N (YES in step ST3C), the processing in step ST3B is repeated until reaching the predetermined value N.

Subsequently, the first Fourier transformer 3 calculates a power spectrum $Y_n(k)$ and a phase spectrum $P_n(k)$ from the spectral component $X_{w_n}(k)$ of the input signal by using the foregoing mathematical equations (2) (step ST3D). The power spectrum $Y_n(k)$ is output to the neural network processor 4 which will be described later. The phase spectrum $P_n(k)$ is output to the inverse Fourier transformer 5 which will be described later. The above process of calculating the power spectrum and the phase spectrum in step ST3D is repeated until reaching M=128 while the spectrum number k is smaller than the predetermined value M (YES in step ST3E).

The neural network processor 4 has M input points (or nodes) corresponding to the power spectrum $Y_n(k)$ described above, and 128 power spectrum $Y_n(k)$ are input to the neural network (step ST4A). In the power spectrum $Y_n(k)$, the target signal is enhanced by network processing based on a coupling coefficient having been learned in advance (step ST4B). An enhanced power spectrum $S_n(k)$ is output.

The inverse Fourier transformer 5 performs inverse Fourier transform using the enhanced power spectrum $S_n(k)$ output from the neural network processor 4 and the phase spectrum $P_n(k)$ output from the first Fourier transformer 3 (step ST5A). The inverse Fourier transformer 5 performs a superimposing process on a result of the inverse Fourier transform with a result of a previous frame stored in an internal memory for primary storage such as a RAM (step ST5B), and outputs a weighted enhancement signal $s_{w_n}(t)$ to the inverse filter 6.

The inverse filter 6 performs, by using the weighting coefficient $w_n(j)$ output from the first signal weighting processor 2, an operation reverse to that of the first signal weighting processor 2, that is, a filtering process to cancel the weighting on the weighted enhancement signal $s_{w_n}(t)$ (step ST6), and outputs an enhancement signal $s_n(t)$.

The signal output part 7 externally outputs the enhancement signal $s_n(t)$ (step ST7A). When the sound signal enhancing process is continued after step ST7A (YES in step ST7B), the processing procedure returns to step ST1A. On the other hand, when the sound signal enhancing process is not continued (NO in step ST7B), the sound signal enhancing process is terminated.

Next, an example of operation for learning a neural network during the above sound signal enhancing process will be described with reference to FIG. 4. FIG. 4 is a flowchart schematically illustrating an example of the procedure of neural network learning of the Embodiment 1.

The supervisory signal outputer 8 holds a large amount of signal data for learning coupling coefficients in the neural network processor 4, outputs the supervisory signal $d_n(t)$ at the time of the learning, and outputs an input signal to the first signal weighting processor 2 (step ST8). In the present embodiment, it is assumed that the target signal is speech sound, the supervisory signal is a speech signal not including noise, and the input signal is a speech signal including noise.

The second signal weighting processor 9 performs a weighting process similar to that performed by the first signal weighting processor 2 on the supervisory signal $d_n(t)$ (step ST9), and outputs a weighted supervisory signal $d_{w_n}(t)$.

The second Fourier transformer 10 performs a fast Fourier transform process similar to that performed by the first Fourier transformer 3 (step ST10), and outputs a power spectrum $D_n(k)$ of the supervisory signal.

The error evaluator 11 calculates the learning error E through the foregoing mathematical equation (3) by using the enhanced power spectrum $S_n(k)$ output from the neural network processor 4 and the power spectrum $D_n(k)$ of the supervisory signal output from the second Fourier transformer 10 (step ST11A). Using the calculated learning error E as an evaluation function, an amount of change in a coupling coefficient is calculated by, for example, a back propagation method (step ST11B). The amount of change in the coupling coefficient is output to the neural network processor 4 (step ST11C). The learning error evaluation is performed until the learning error E becomes less than or equal to a predetermined threshold value Eth. Specifically, when the learning error E is larger than the threshold value Eth (YES in step STUD), the learning error evaluation (step ST11A) and the recalculation of the coupling coefficient (step STAB) are performed, and the recalculation result is output to the neural network processor 4 (step ST11C). Such processing is repeated until the learning error E becomes less than or equal to the predetermined threshold value Eth (NO in step ST11D).

Note that, in the above description, the procedure of the neural network learning is denoted as steps ST8 to ST11 as step numbers following the procedure of the sound signal enhancing process of steps ST1 to ST7. However, in general, steps ST8 to ST11 are executed before execution of steps ST1 to ST7. Alternatively, as will be described later, steps ST1 to ST7 and steps ST8 to ST11 may be executed simultaneously in parallel.

A hardware structure of the sound signal enhancement device can be implemented by a computer incorporating a central processing unit (CPU) such as a workstation, a mainframe, a personal computer, or a microcomputer for incorporation in a device. Alternatively, a hardware structure of the sound signal enhancement device may be implemented by a large scale integrated circuit (LSI) such as a digital signal processor (DSP), an application specific integrated circuit (ASIC), or a field-programmable gate array (FPGA).

FIG. 5 is a block diagram illustrating an example of a hardware structure of the sound signal enhancement device 100 made up by using an LSI such as a DSP, an ASIC, or an FPGA. In the example of FIG. 5, the sound signal enhancement device 100 includes signal input/output circuitry 102, signal processing circuitry 103, a recording medium 104, and a signal path 105 such as a date bus. The signal input/output circuitry 102 is an interface circuit which implements a connection function with a sound transducer 101 and an external device 106. As the sound transducer 101, a device which captures sound vibrations of a microphone, a vibration sensor, or the like and converts the vibrations into an electric signal can be used.

The respective functions of the first signal weighting processor 2, the first Fourier transformer 3, the neural network processor 4, the inverse Fourier transformer 5, the inverse filter 6, the supervisory signal outputer 8, the second signal weighting processor 9, the second Fourier transformer 10, and the error evaluator 11 illustrated in FIG. 1 can be implemented by the signal processing circuitry 103 and the recording medium 104. The signal input part 1 and the signal output part 7 in FIG. 1 correspond to the signal input/output circuitry 102.

The recording medium 104 is used to accumulate various data such as various setting data of the signal processing circuitry 103 or signal data. As the recording medium 104, for example, a volatile memory such as a synchronous DRAM (SDRAM), a nonvolatile memory such as a hard disk drive (HDD) or a solid state drive (SSD) can be used, and an initial state of each coupling coefficient of the neural network, various setting data, and supervisory signal data can be stored therein.

The sound signal subjected to the enhancing process by the signal processing circuitry 103 is sent toward the external device 106 via the signal input/output circuitry 102. Various speech sound processing devices may be used as the external device 106, such as a voice coding device, a voice recognition device, a voice accumulation device, a hands-free communication device, an abnormal sound detection device. Furthermore, it is also possible, as a function of the external device 106, to amplify the sound signal subjected to the enhancing process by an amplifying device and to directly output the sound signal as a sound waveform by a speaker or other devices. Note that the sound signal enhancement device of the present embodiment can be implemented by a DSP or the like together with other devices as described above.

FIG. 6 is a block diagram illustrating an example of a hardware structure of the sound signal enhancement device 100 made up by using an operation device such as a computer. In the example of FIG. 6, the sound signal enhancement device 100 includes signal input/output circuitry 201, a processor 200 incorporating a CPU 202, a memory 203, a recording medium 204, and a signal path 205 such as bus. The signal input/output circuitry 201 is an interface circuit that implements the connection function with the sound transducer 101 and the external device 106.

The memory 203 is a storage means, such as a ROM and a RAM which are used as a program memory for storing various programs for implementing the sound signal enhancing process of the present embodiment, a work memory used by the processor for performing data processing, a memory for developing signal data, or the like.

The respective functions of the first signal weighting processor 2, the first Fourier transformer 3, the neural network processor 4, the inverse Fourier transformer 5, the inverse filter 6, the supervisory signal outputer 8, the second signal weighting processor 9, the second Fourier transformer 10, and the error evaluator 11 can be implemented by the processor 200 and the recording medium 204. The signal input part 1 and the signal output part 7 in FIG. 1 correspond to the signal input/output circuitry 201.

The recording medium 204 is used to accumulate various data such as various setting data of the processor 200 and signal data. As the recording medium 204, for example, a volatile memory such as an SDRAM, an HDD, or an SSD can be used. Programs including an operating system (OS), various data such as various setting data and sound signal data can be accumulated. Note that data in the memory 203 can be stored also in the recording medium 204.

The processor 200 can execute signal processing similar to that of the first signal weighting processor 2, the first Fourier transformer 3, the neural network processor 4, the inverse Fourier transformer 5, the inverse filter 6, the supervisory signal outputer 8, the second signal weighting processor 9, the second Fourier transformer 10, and the error evaluator 11 by using the RAM in the memory 203 as a working memory and operating in accordance with a computer program read from the ROM in the memory 203.

The sound signal subjected to the enhancing process is sent toward the external device 106 via the signal input/output circuitry 201. Various speech sound processing devices correspond to the external device such as a voice coding device, a voice recognition device, a voice accumulation device, a hands-free communication device, an abnormal sound detection device, for example. Furthermore, it is also possible to implement, as a function of the external device 106, to amplify the sound signal subjected to the enhancing process by an amplifying device and to directly output the sound signal as a sound waveform by a speaker or other devices. Note that the sound signal enhancement device of the present embodiment can be implemented by execution as a software program together with other devices as described above.

A program for executing the sound signal enhancement device of the present embodiment may be stored in a storage device inside a computer for executing the software program or may be distributed by a storage medium such as a CD-ROM. Alternatively, it is possible to acquire the program from another computer via a wireless or a wired network such as a local area network (LAN). Furthermore, regarding the sound transducer 101 and the external device 106 connected to the sound signal enhancement device 100 of the present embodiment, various data may be transmitted and received via a wireless or a wired network.

The sound signal enhancement device of the Embodiment 1 is configured as described above. That is, prior to learning of a neural network, part of speech sound as a target signal indicating an important feature is enhanced. Therefore, it is possible to efficiently learn the neural network even when the amount of target signals serving as supervisory data is small, thereby enabling provision of the high-quality sound signal enhancement device. In addition, for noise other than the target signal (disturbance sound), an effect similar to that in the case of the target signal (in this case, functions to reduce the noise) is obtained. Therefore, it is possible to efficiently learn even when input signal data including noise with low occurrence frequency cannot be sufficiently prepared, thereby it is capable of providing a high quality sound signal enhancement device.

Furthermore, according to the Embodiment 1, since supervisory data can be changed depending on a mode of the input signal for sequential or constant operation, it is possible to sequentially optimize the coupling coefficients of the neural network. Therefore, even when the type of the input signal changes, for example, when the type or the magnitude of noise included in the input signal changes, a sound signal enhancement device capable of promptly following the change in the input signal can be provided.

As described above, the sound signal enhancement device of the Embodiment 1 includes: a first signal weighting processor configured to perform a weighting on part of an input signal representing a feature of a target signal, and configured to output a weighted signal, the input signal including the target signal and the noise; a neural network processor configured to perform, on the weighted signal output from the first signal weighting processor, enhancement of the target signal by using a coupling coefficient, and configured to output an enhancement signal; an inverse filter configured to cancel the weighting on the feature representation of the target signal in the enhancement signal; a second signal weighting processor configured to perform a weighting on part of an supervisory signal representing a feature of a target signal, and configured to output a weighted signal, the supervisory signal being used for learning a neural network; and an error evaluator configured to calculate a coupling coefficient having a value indicating that a learning error between the weighted signal output from the second signal weighting processor and the enhancement signal output from the neural network processor is less than or equal to a set value, and configured to output a result of the calculation as the coupling coefficient. Therefore, it is possible to obtain a high-quality enhancement signal of a sound signal even when the amount of learning data is small.

Furthermore, the sound signal enhancement device of the Embodiment 1 includes: a first signal weighting processor configured to perform a weighting on part of an input signal representing a feature of a target signal, and configured to output a weighted signal, the input signal including the target signal and the noise; a first Fourier transformer configured to transform, into a spectrum, the weighted signal output from the first signal weighting processor; a neural network processor configured to perform, on the spectrum, enhancement of the target signal by using a coupling coefficient, and configured to output an enhancement signal; an inverse Fourier transformer configured to transform the enhancement signal output from the neural network processor into an enhancement signal in a time domain; an inverse filter configured to cancel the weighting on the feature representation of the target signal in the enhancement signal output from the inverse Fourier transformer; a second signal weighting processor configured to perform a weighting on part of an supervisory signal representing a feature of a target signal, and configured to output a weighted signal, the supervisory signal being used for learning a neural network; and a second Fourier transformer configured to transform the weighted signal output from the second signal weighting processor into a spectrum; and an error evaluator configured to calculate a coupling coefficient having a value indicating that a learning error between an output signal from second Fourier transformer and the enhancement signal output from the neural network processor is less than or equal to a set value, and configured to output a result of the calculation as the coupling coefficient. Therefore, it is possible to efficiently learn even when the amount of target signals serving as supervisory signals is small, and the high-quality sound signal enhancement device can be provided. In addition, for noise other than the target signal (disturbance sound), an effect similar to that in the case of the target signal (in this case, functions to reduce the noise) is obtained. Therefore, it is possible to efficiently learn even in a situation in which input signal data included with noise with low occurrence frequency cannot be sufficiently prepared, thereby it is capable of providing a high quality sound signal enhancement device.

Embodiment 2

In the foregoing Embodiment 1, the weighting process of the input signal is performed in the time waveform domain. Alternatively, it is possible to perform the weighting process of an input signal in the frequency domain. This configuration will be described as Embodiment 2.

FIG. 7 illustrates an internal configuration of a sound signal enhancement device according to the Embodiment 2. In FIG. 7, configurations different from those of the sound signal enhancement device of the Embodiment 1 illustrated in FIG. 1 includes a first signal weighting processor 12, an inverse filter 13, and a second signal weighting processor 14. Other configurations are similar to those of the Embodiment 1, and thus the same symbol is provided to corresponding parts, and descriptions thereof will be omitted.

The first signal weighting processor 12 is a processing part that receives a power spectrum $Y_n(k)$ output from a first Fourier transformer 3, performs in the frequency domain a process equivalent to that in the first signal weighting processor 2 of the foregoing Embodiment 1, and outputs a weighted power spectrum $Y_{w_n}(k)$. In addition, the first signal weighting processor 12 outputs a frequency weighting coefficient $W_n(k)$ which is set for each frequency, that is, for each power spectrum.

The inverse filter 13 receives the frequency weighting coefficient $W_n(k)$ output by the first signal weighting processor 12 and an enhanced power spectrum $S_n(k)$ output by a neural network processor 4, performs in the frequency domain a process equivalent to that in the inverse filter 6 of the foregoing Embodiment 1, and obtains inverse filter outputs of the enhanced power spectrum $S_n(k)$.

The second signal weighting processor 14 receives a power spectrum $D_n(k)$ of an supervisory signal output by a second Fourier transformer 10 and performs in the frequency domain a process equivalent to that in the second signal weighting processor 9 of the foregoing Embodiment 1, and outputs a weighted power spectrum $D_{w_n}(k)$ of the supervisory signal.

In the sound signal enhancement device according to the Embodiment 2 configured in the above-described manner, the signal input part 1 outputs the input signal $x_n(t)$ of the time domain to the first Fourier transformer 3. The first Fourier transformer 3 performs the process equivalent to that in the Embodiment 1 on an input signal $x_n(t)$, and calculates the power spectrum $Y_n(k)$ and a phase spectrum $P_n(k)$. The first Fourier transformer 3 outputs the power spectrum $Y_n(k)$ to the first signal weighting processor 12 and outputs the phase spectrum $P_n(k)$ to an inverse Fourier transformer 5. The first signal weighting processor 12 receives the power spectrum $Y_n(k)$ output by the first Fourier transformer 3, performs in the frequency domain the process equivalent to that in the first signal weighting processor 2 of the Embodiment 1, and outputs the weighted power spectrum $Y_{w_n}(k)$ and the frequency weighting coefficient $W_n(k)$. The neural network processor 4 enhances the target signal out of the weighted power spectrum $Y_{w_n}(k)$ and outputs the enhanced power spectrum $S_n(k)$. The inverse filter 13 performs on the enhanced power spectrum $S_n(k)$ an operation reverse to that in the first signal weighting processor 2, that is, a filtering process to cancel the weighting by using the frequency weighting coefficient $w_n(k)$ output from the first signal weighting processor 12, and outputs a result of the inverse filter operation to the inverse Fourier transformer 5. The inverse Fourier transformer 5 performs inverse Fourier transform using the phase spectrum $P_n(k)$ output from the first Fourier transformer 3, performs a superimposing process on the result of the inverse filter operation with a result of a previous frame stored in an internal memory for primary storage such as a RAM, and outputs an enhancement signal $s_n(t)$ to the signal output part 7.

The operation of the neural network learning of the Embodiment 2 is different from that of the Embodiment 1 in that, after the Fourier transform is performed by the second Fourier transformer 10 on the supervisory signal $d_n(t)$ output by a supervisory signal outputer 8, the weighting is performed by the second signal weighting processor 14. That is, the second Fourier transformer 10 performs, on the supervisory signal $d_n(t)$, a fast Fourier transform process equivalent to that in the first Fourier transformer 3 and outputs a power spectrum $D_n(k)$ of the supervisory signal. The second signal weighting processor 14 performs, on the power spectrum $D_n(k)$ of the supervisory signal, the weighting process equivalent to that in the first signal weighting processor 12 and outputs a weighted power spectrum $D_{w_n}(k)$ of the supervisory signal.

The error evaluator 11 calculates a learning error E and recalculates coupling coefficients until the learning error E becomes less than or equal to a predetermined threshold value Eth similar to the Embodiment 1 by using the enhanced power spectrum $S_n(k)$ output from the neural network processor 4 and the weighted power spectrum $D_{w_n}(k)$ of the supervisory signal output from the second signal weighting processor 14.

As described above, the sound signal enhancement device of the Embodiment 2 includes: a first Fourier transformer configured to transform, into a spectrum, an input signal including a target signal and noise; a first signal weighting processor configured to perform a weighting in a frequency domain on part of the spectrum representing a feature of a target signal, and configured to output a weighted signal; a neural network processor configured to perform, on the weighted signal output from the first signal weighting processor, enhancement of the target signal by using a coupling coefficient, and configured to output an enhancement signal; an inverse filter configured to cancel the weighting on the feature representation of the target signal in the enhancement signal; an inverse Fourier transformer configured to transform an output signal from the inverse filter into an enhancement signal in a time domain; a second Fourier transformer configured to transform an supervisory signal into a spectrum, the supervisory signal being used for learning a neural network; a second signal weighting processor configured to perform a weighting on part of an output signal from the second Fourier transformer representing a feature of a target signal, and configured to output a weighted signal; and an error evaluator configured to calculate a coupling coefficient having a value indicating that a learning error between the weighted signal output from second Fourier transformer and the enhancement signal output from the neural network processor is less than or equal to a set value, and configured to output a result of the calculation as the coupling coefficient. Therefore, in addition to the effect of the Embodiment 1, more precise weighting is enabled since it is possible to finely set weight for each frequency and to perform a plurality of pieces of weighting process at a time in the frequency domain by weighting the input signal in the frequency domain, thereby enabling provision of an even more high-quality sound signal enhancement device.

Embodiment 3

In the foregoing Embodiments 1 and 2 described above, a power spectrum being a signal in the frequency domain is input to and output from the neural network processor 4. Alternatively, it is possible to input a time waveform signal. This configuration will be described as Embodiment 3.

FIG. 8 illustrates an internal configuration of a sound signal enhancement device according to the present embodiment. In FIG. 8, an operation of an error evaluator 15 is different from that in FIG. 1. Other configurations are similar to those in FIG. 1, and thus the same symbols are provided to corresponding parts, and descriptions thereof will be omitted.

A neural network processor 4 receives weighted input signals $x_{w_n}(t)$ output from the first signal weighting processor 2, and outputs, similar to the neural network processor 4 of the foregoing Embodiment 1, enhancement signals $s_n(t)$ in which a target signal is enhanced.

The error evaluator 15 calculates a learning error Et through the following mathematical equation (4) by using the enhancement signals $s_n(t)$ output from the neural network processor 4 and a weighted supervisory signal $d_{w_n}(t)$ output by a second signal weighting processor 9. The error evaluator 15 calculates and outputs a coupling coefficient to the neural network processor 4.

$$Et = \sum_{t=0}^{T-1} \{s_n(t) - d_{w_n}(t)\}^2 \tag{4}$$

T is the number of samples in a time frame, and T=80.

Since other operations are similar to those of the Embodiment 1, and thus descriptions here are omitted.

As described above, in the sound signal enhancement device of the Embodiment 3, the input signal and the supervisory signal are time waveform signals. Accordingly, by inputting the time waveform signals directly to the neural network, the Fourier transform and inverse Fourier transform processes are not needed, thereby achieving an effect that a processing amount and a memory amount can be reduced.

Note that, although the neural network has a four-layer structure in the foregoing Embodiments 1 to 3, the present invention is not limited thereto. It is understood without saying that a neural network having a deeper structure of five or more layers may be used. Alternatively, a known derivative improved type of a neural network may be used such as a recurrent neural network (RNN) for returning a part of an output signal to an input thereto or a long short-term memory (LSTM)-RNN which is an RNN with improved structure of coupling elements.

Furthermore, in the foregoing Embodiments 1 and 2, frequency components of a power spectrum output by the first Fourier transformer 3 are input to the neural network processor 4. Alternatively, it is possible to collectively input frequency components of the power spectrum for each specific bandwidth. The specific bandwidth may be, for example, a critical bandwidth. That is, a Bark spectrum, which is band-divided with the so-called Bark scale, may be input to the neural network. By inputting the Bark spectrum, it becomes possible to simulate human auditory features, and the number of nodes of a neural network can be reduced, and thus the amount of processing and the amount of memory required for neural network operation can be reduced. Alternatively, similar effects can be obtained by using the Mel scale as an example other than the Bark spectrum.

Furthermore, in each of the foregoing embodiments, although street noise has been described as an example of noise and speech has been an example of the target signal, the present invention is not limited thereto. The present invention may be applied to, for example, driving noise of an automobile or a train, aircraft noise, lift operation noise such as an elevator, machine noise in plants, included noises in which a large amount of human voice is included such as that in an exhibition hall or other places, living noise in a general household, sound echoes generated from received sound at the time of hands-free communication. Also for these types of noise and target signals, the effects described in the respective embodiments are similarly exerted.

Moreover, although it has been assumed that the frequency bandwidth of the input signal is 4 kHz, the present invention is not limited thereto. The present invention may be applied to, for example, speech signals of a broadband, an ultrasonic wave having a frequency higher than or equal to 20 kHz that cannot be heard by a person, and a low frequency signal having a frequency lower than or equal to 50 Hz.

Other than the above, within the scope of the present invention, the present invention may include a modification of any component of the respective embodiments, or an omission of any component in the respective embodiments.

As described above, a sound signal enhancement device according to the present invention is capable of high-quality signal enhancement (or noise suppression or sound echo reduction) and thus is suitable for use for improvement of the sound quality of voice recognition systems such as car navigation, mobile phones, and interphones, hands-free communication systems, TV conference systems, and monitoring systems in which any one of voice communication, voice accumulation, a voice recognition system is introduced, improvement of the recognition rate of voice recognition systems, and improvement of the detection rate of abnormal sound of automatic monitoring systems.

REFERENCE SIGNS LIST

1: Signal inputter; 2 and 12: First signal weighting processor; 3: First Fourier transformer; 4: Neural network processor; 5: Inverse Fourier transformer; 6: Inverse filter; 7: Signal outputer; 8: Supervisory signal outputer; 9 and 14: Second signal weighting processor; 10: Second Fourier transformer; 11 and 15: Error evaluator; 13: Inverse filter

The invention claimed is:

1. A sound signal enhancement device, comprising:

a processor; and a memory coupled to the processor, the memory storing instructions which, when executed, causes the processor to perform a process including, performing a weighting on part of an input signal representing a feature of a target signal, and to output a weighted signal, the input signal including the target signal and the noise;

executing neural network processing to perform, on the weighted signal, enhancement of the target signal by using a coupling coefficient, to output an enhancement signal;

performing inverse filtering to cancel the weighting on the feature representation of the target signal in the enhancement signal;

performing a second weighting on part of a supervisory signal representing a feature of a target signal, to output a second weighted signal, the supervisory signal being used for learning a neural network; and calculating a coupling coefficient having a value indicating that a learning error between the second weighted signal and the enhancement signal output from the neural network processing is less than or equal to a set value, and outputting a result of the calculation as the coupling coefficient.

2. The sound signal enhancement device according to claim 1, wherein each of the input signal and the supervisory signal is a time waveform signal.

3. A sound signal enhancement device, comprising:

a processor; and a memory coupled to the processor, the memory storing instructions which, when executed, causes the processor to perform a process including, performing a weighting on part of an input signal representing a feature of a target signal, and to output a weighted signal, the input signal including the target signal and the noise;

applying a Fourier transform on the weighted signal to transform, into a spectrum, the weighted signal;

executing neural network processing to perform, on the spectrum, enhancement of the target signal by using a coupling coefficient, to output an enhancement signal;

applying an inverse Fourier transform on the outputted enhancement signal to transform the outputted enhancement signal into an enhancement signal in a time domain;

performing inverse filtering to cancel the weighting on the feature representation of the target signal in the enhancement signal in the time domain;

performing a second weighting on part of a supervisory signal representing a feature of a target signal, to output a second weighted signal, the supervisory signal being used for learning a neural network; and applying a second Fourier transform on the second weighted signal to transform the second weighted signal into a spectrum; and calculating a coupling coefficient having a value indicating that a learning error between an output signal from the second Fourier transform and the enhancement signal output from the neural network processing is less than or equal to a set value, and outputting a result of the calculation as the coupling coefficient.

4. A sound signal enhancement device, comprising:

a processor; and a memory coupled to the processor, said memory storing instructions which, when executed, causes the processor to perform a process including, applying a first Fourier transform on an input signal to transform, into a spectrum, said input signal including a target signal and noise;

performing a weighting in a frequency domain on part of the spectrum representing a feature of a target signal, to output a weighted signal;

executing a neural network processing to perform, on the weighted signal, enhancement of the target signal by using a coupling coefficient, to output an enhancement signal;

performing inverse filtering to cancel the weighting on the feature representation of the target signal in the outputted enhancement signal;

applying an inverse Fourier transform to transform a signal obtained from the inverse filtering into an enhancement signal in a time domain;

applying a second Fourier transform on a supervisory signal to transform the supervisory signal into a spectrum, the supervisory signal being used for learning a neural network;

performing a second weighting on part of an output signal from the second Fourier transform representing a feature of a target signal, to output a second weighted signal; and calculating a coupling coefficient having a value indicating that a learning error between the second weighted signal and the enhancement signal output from the neural network processor is less than or equal to a set value, and outputting a result of the calculation as the coupling coefficient.

* * * * *